United States Patent [19]

Fujiwara

[11] Patent Number: 4,714,521

[45] Date of Patent: Dec. 22, 1987

[54] TWIN WIRE FORMER WITH AN IMPERMEABLE BELT INSIDE THE TOP WIRE

[75] Inventor: Haruyoshi Fujiwara, Hiroshima, Japan

[73] Assignee: Mitsubishi Jukogyo Kabushiki Kaisha, Tokyo, Japan

[21] Appl. No.: 882,978

[22] PCT Filed: Nov. 13, 1985

[86] PCT No.: PCT/JP85/00632

§ 371 Date: Jun. 25, 1986

§ 102(e) Date: Jun. 25, 1986

[87] PCT Pub. No.: WO86/02961

PCT Pub. Date: May 22, 1986

[30] Foreign Application Priority Data

Nov. 15, 1984 [JP] Japan ..... 59-241475

[51] Int. Cl.[4] ..... D21F 9/02; D21F 1/00

[52] U.S. Cl. ..... 162/300; 162/301; 162/351

[58] Field of Search ..... 162/300, 301, 303, 305, 162/351, 348, 352

[56] References Cited

U.S. PATENT DOCUMENTS

| | | | |
|---|---|---|---|
| 2,501,716 | 3/1950 | Friel | 162/305 |
| 2,821,120 | 1/1958 | Thomas et al. . | |
| 3,201,305 | 8/1965 | Webster . | |
| 3,797,384 | 3/1974 | Hoff . | |
| 3,810,818 | 5/1974 | Arledter . | |
| 3,840,430 | 10/1974 | Ely | 162/301 |
| 4,417,950 | 11/1983 | Bubik et al. | 162/300 |
| 4,491,521 | 1/1985 | Wenske et al. . | |

FOREIGN PATENT DOCUMENTS

| | | | |
|---|---|---|---|
| 146316 | 2/1981 | Fed. Rep. of Germany | 162/352 |
| 3532458 | 3/1986 | Fed. Rep. of Germany | 162/351 |
| 53-2608 | 1/1978 | Japan . | |

*Primary Examiner*—S. Leon Bashore
*Assistant Examiner*—K. M. Hastings
*Attorney, Agent, or Firm*—Wenderoth, Lind & Ponack

[57] ABSTRACT

The present invention relates to a twin wire former. It aims at resolving the difficulties with respect to the retention of fine raw material and the coupling strength in the thicknesswise direction of a paper sheet without deteriorating the formation and without causing problems associated with high speed operation. A top wire (34) is partly provided with a portion in which a water-impermeable belt (35) travels along the inside of its loop. Dewatering in this portion is effected only on one side, that is, on the side of the bottom wire (33). Also in this portion, wrapping angles for the wires (33) and (34) are varied by adjusting the positions of a plurality of rolls (3), (17) and (23) or shoes (14) and (18) to improve the formation, and thereafter, dewatering on the side where dewatering has been suppressed by the above-mentioned belt (35) is also effected.

1 Claim, 4 Drawing Figures

TWIN WIRE FORMER WITH AN IMPERMEABLE BELT INSIDE THE TOP WIRE

FIELD OF THE INVENTION

The present invention relates to a twin wire former that is used as a former (i.e. having a formation forming section) in a paper making machine.

DESCRIPTION OF THE RELATED ART

What determines the nature of a paper sheet is mostly the performance of a paper making machine from an initial portion thereof to a former. With respect to the performance required for this former, it is required that retention of raw material is good, that a paper sheet having a large strength can be formed, that only small differences in quality exists such as printability or the like between the front and back surfaces of the paper sheet, that a paper sheet having a large surface strength can be formed, that high speed operation is possible, and that the former can be operated consistently, etc. While various types of formers have been invented in order to fulfill these requirements, any one of them has not fulfilled all the requirements. In the case of the Bel-Baie former in the prior art as shown in FIG. 3, although these requirements were almost fulfilled, there were difficulties in the retention of fine raw material and in the coupling strength in a thicknesswise direction of paper sheets formed thereby.

According to research and investigation, it has been known that after a raw material liquid has been sandwiched between two wires, if dewatering is carried out while scrubbing the wire with a fixed body, then a lot of fine raw material would flow therefrom, that is, retention is lowered. If one employs the construction such that the number of fixed bodies for scrubbing the wire such as shoe blades a, suction boxes b and the like in FIG. 3 are reduced and the number of dewatering means comprising a rotary body such as a suction couch roll c and the like are increased in order to improve the retention, then while the retention is improved, the formation is deteriorated.

With regard to the strength in the thicknesswise direction of a paper sheet, if a paper raw material liquid is sandwiched between two wires d and e and dewatering is effected from the both surfaces to form a fiber mat, then a paper sheet having a structure in which the coupling strength in the thicknesswise direction is low as compared to the case where dewatering is effected from only one surface to form a fiber mat, is formed. In order to reduce differences between the top and bottom surfaces of a paper sheet, it is necessary to dewater at both surfaces to form a mat, and for that purpose, considerably asymmetric both-surface dewatering would suffice. In the case of the asymmetric both-surface dewatering, lowering of the coupling strength in the thicknesswise direction can be also suppressed to a little extent.

In the above-mentioned type of formers, many formers in which a top wire unit is provided at a rear portion of a long wire, are known. One example of the formers is illustrated in FIG. 4. However, in such type of former as shown in FIG. 4, that is, in the former of the type that a long wire f and a twin wire former g in the prior art are joined together (hybrid former), when carrying out high speed operation, a raw material liquid is subjected to an excessive influence by pulse pressure produced by dewatering elements such as foils or the like provided in the portion of the long wire f, resulting in the destruction of the texture of the paper. Therefore, the former was not always suitable for high speed operation. It is to be noted that h in FIGS. 3 and 4 represents a headbox, i in FIG. 3 represents a water deflector, and j represents a vacuum deflector.

SUMMARY OF THE INVENTION

It is therefore one object of the present invention to resolve the difficulties in the prior art twin wire formers with respect to the retention to fine raw material and the coupling strength in the thicknesswise direction of a paper sheet, without an accompanying problem of the texture is being deteriorated or that the former is not suitable for high speed operation being presented.

To that end, according to the present invention, in a twin wire former the top wire is partly provided with a portion in which a water-impermeable belt is made to travel along the inside of the loop, so that dewatering in this portion is effected only on one side, i.e. the bottom wire side, and in this portion a wrapping angle for the wire is varied by adjusting the positions of a plurality of rolls or shoes to improve the formation. Thereafter, dewatering on the side where dewatering has been suppressed by the above-mentioned belt is also effected, and this construction is employed as a measure for resolving the problems.

The present invention will be explained below with reference to its preferred embodiment illustrated in the accompanying drawings.

DETAILED DESCRIPTION OF THE PREFERRED EMBODIMENT

Figure 1:
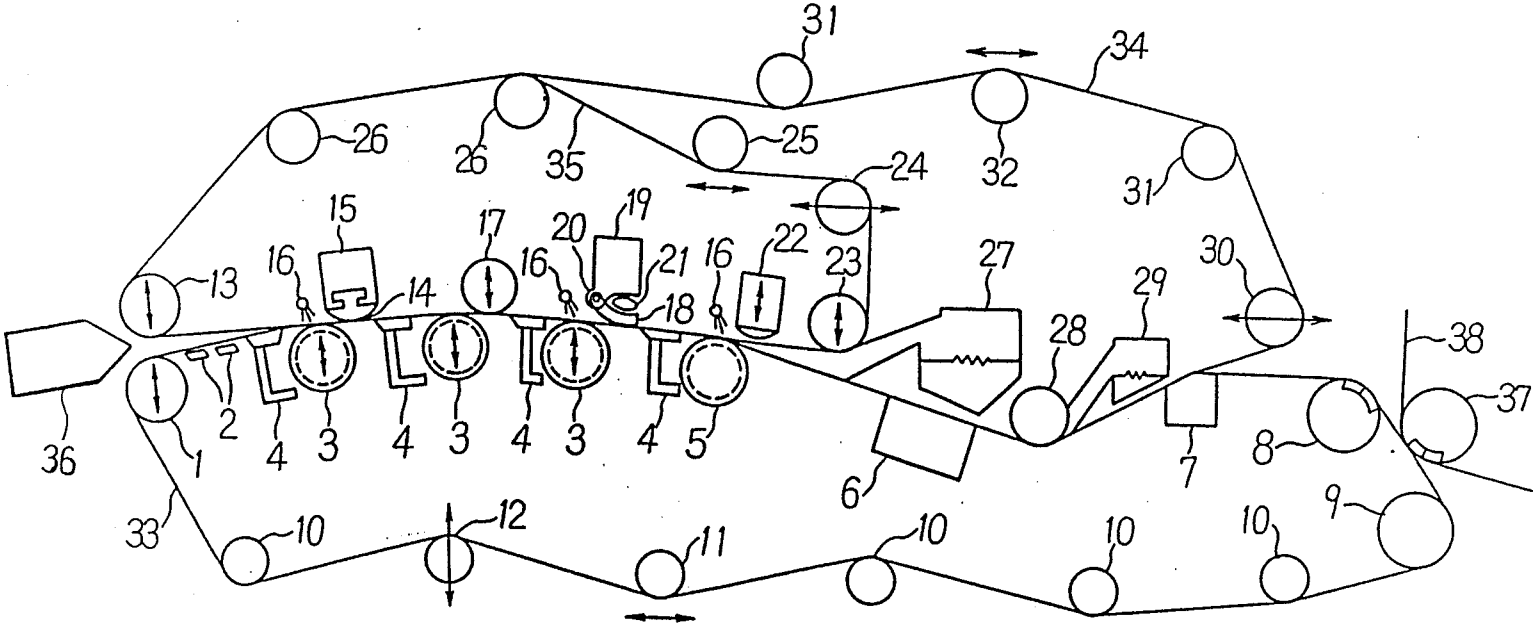
FIG. 1 is a side cross-sectional view showing one preferred embodiment of a twin wire former according to the present invention.

FIG. 1 shows the preferred embodiment of the present invention in which raw material ejected from a headbox 36 is sandwiched between a bottom wire 33 and a top wire 34. However, initially, upward dewatering is not effected because a water-impermeable belt 35 is traveling along the top wire 34. In addition, a breast roll 1 is supported in a vertically adjustable manner.

Reference numeral 2 designates forming boards, and numeral 3 designates open rolls which enable adjustment of a wrapping angle of the bottom wire by adjustment of their vertical positions. Reference numeral 4 designates deflectors which prevent white water removed at the portion of the forming boards 2 from striking against the open rolls so as to not be brought again into inlet nips between the bottom wire 33 and the open rolls 3. The deflector 4 can be adjusted with respect to the engagement thereof with the wire in accordance with the vertical position adjustment of the breast roll 1 or the open rolls 3. The forming boards 2 are also adjustable. It is assumed that multiple open rolls 3 and the deflectors 4 are provided. A roll 5 is an open roll similar to the open rolls 3 or a suction roll, but its position is fixed.

Reference numeral 6 designates an optional suction box. In addition, while reference numeral 7 designates a suction box. Its surface is a curved, and it ensures that a fiber mat leaves the top wire 34 and travels on the bottom wire 33. Numeral 8 designates a suction couch roll, numeral 9 designates a turning roll, numeral 10 designates a return wire roll, numeral 11 designates a wire guide roll, and numeral 12 designates a stretch roll.

A wet paper sheet is transferred by a suction roll 37 to a felt 38 and is carried to a press. A top breast roll 13 is vertically adjustable similarly to the breast roll 1, and so it is possible to gradually pinch a jet by reducing a converging angle between the top wire 34 and the bottom wire 33. Reference numeral 15 designates a beam extending in the widthwise direction over the entire width, and it is possible to detachably mount a shoe 14 to the beam 15. The extent to which the top wire 34 is pressed downwards via the belt 35 can be adjusted by employing shoes having different thicknesses or different configurations. Reference numeral 16 designates a shower which feeds lubricant water between the shoes 14 and the belt 35. While the sets of shoes 14 and the shower 16 can be provided respectively behind the rolls 3, the same function performed thereby can be achieved by a roll 17 that is vertically adjustable in position. Or else, as different means, a set of shoes 18 and a pressurizing tube 21 could be employed.

More particularly, the shoe 18 is mounted on a beam 19 extending over the entire width so as to be rotatable about a fulcrum, and the extent to which the top wire 34 is depressed is adjusted by regulating the pressure in the pressurizing tube 21. In order to apply a strong wedge pressure to the raw material sandwiched between both the top and bottom wires, it is also possible to place the shoe 18 above the deflector 4. Or else, as an alternative method, it is also possible that the lower surface of the beam 22 extending over the entire width is used as a shoe and that the amount of depression of the top wire 34 is adjusted by vertically moving this portion.

A roll 23 is supported so as to be vertically adjustable in position, and thereby a wrapping angle of the belt 35 around the roll 5 can be adjusted. Reference numeral 24 designates a stretch roll for the belt 35, numeral 25 designates a guide roll, and numeral 26 designates support rolls for the belt, the rolls being able to simultaneously support the wire 34. Reference numerals 27 and 29, respectively, designate casings for collecting white water extracted on the top wire side, the casings being able to employ a vacuum in combination. Reference numeral 28 designates a wire roll, but it could be an open roll. Numeral 30 designates a stretch roll for the top wire, numeral 31 designates a wire roll, and numeral 32 designates a guide roll.

Now, describing an operation with respect to the preferred embodiment constructed in the above-described manner, based on the adjustment of the positions in the vertical direction of the breast roll 1, the top breast roll 13 and the first open roll 3, a raw material jet ejected from the headbox 36 is gradually sandwiched between two wires 33 and 34 Furthermore, the wrapping angle of the both wires 33 and 34 about the open roll 3 is based upon the position of the adjustable open roll 3. In addition, by adjusting the positions of the shoes 14 and 18, the roll 17, the beam 22 and the like in the direction of the wires, the wrapping angles of the both wires 33 and 34 around these members can be varied, and at the same time the wrapping angles of the both wires 33 and 34 around the open roll 3 and the roll 5 can be adjusted.

At such locations where a wrapping angle exists, due to tension in the wire 33 or in the wire 34 and belt 35 positioned outside of the arc, a pressing pressure acts upon the raw material liquid placed between the two wires, and so, dewatering is effected. In order for the raw material liquid sandwiched between the two wires to pass through the dewatering section in the direction of traveling, it must move from a low pressure side to a high pressure side, and so, it passes while the energy associated with the velocity of the belts is converted to pressure. In other words, the raw material liquid enters the dewatering section while the traveling velocity is reduced and while a dynamic pressure is converted into a static pressure. In the case where the dewatering section is long, the once decelerated raw material liquid is again accelerated by the wires traveling nearly at the same velocity to the same velocity, but in the case where the wrapping angles of the respective dewatering sections are small as shown in FIG. 1, the raw material which has passed a high pressure portion would travel at the wire velocity in a large proportion due to the conversion of a static pressure to dynamic pressure. In any event, each time the raw material passes through the locations of the plurality of rolls 3, the roll 5, the shoes 14 and 18, the roll 17, the beam 22 and the like, dewatering is effected at the respective locations, and acceleration and deceleration in the traveling direction are appropriately applied to the raw material liquid.

Figure 2:
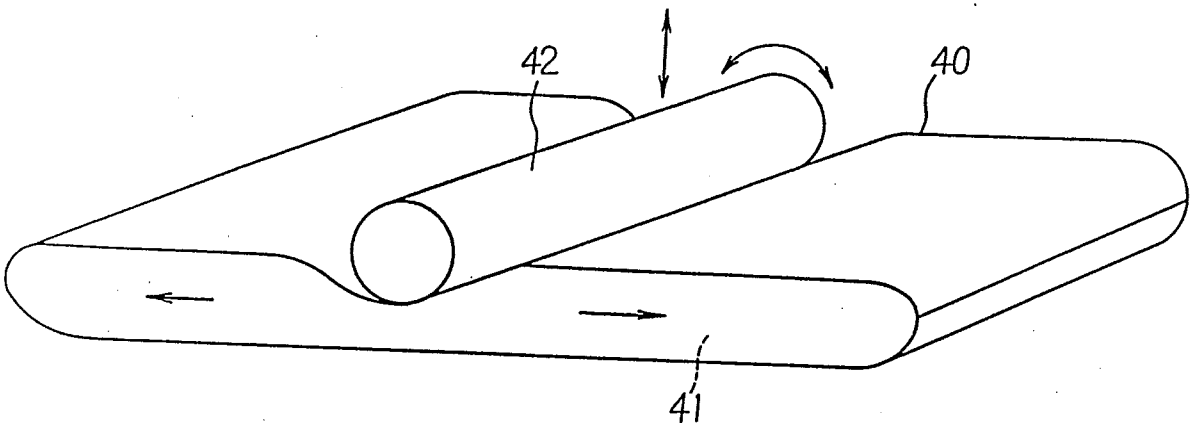
FIG. 2 is a perspective view illustrating that fiber distribution is improved by the present invention.
Figure 3:
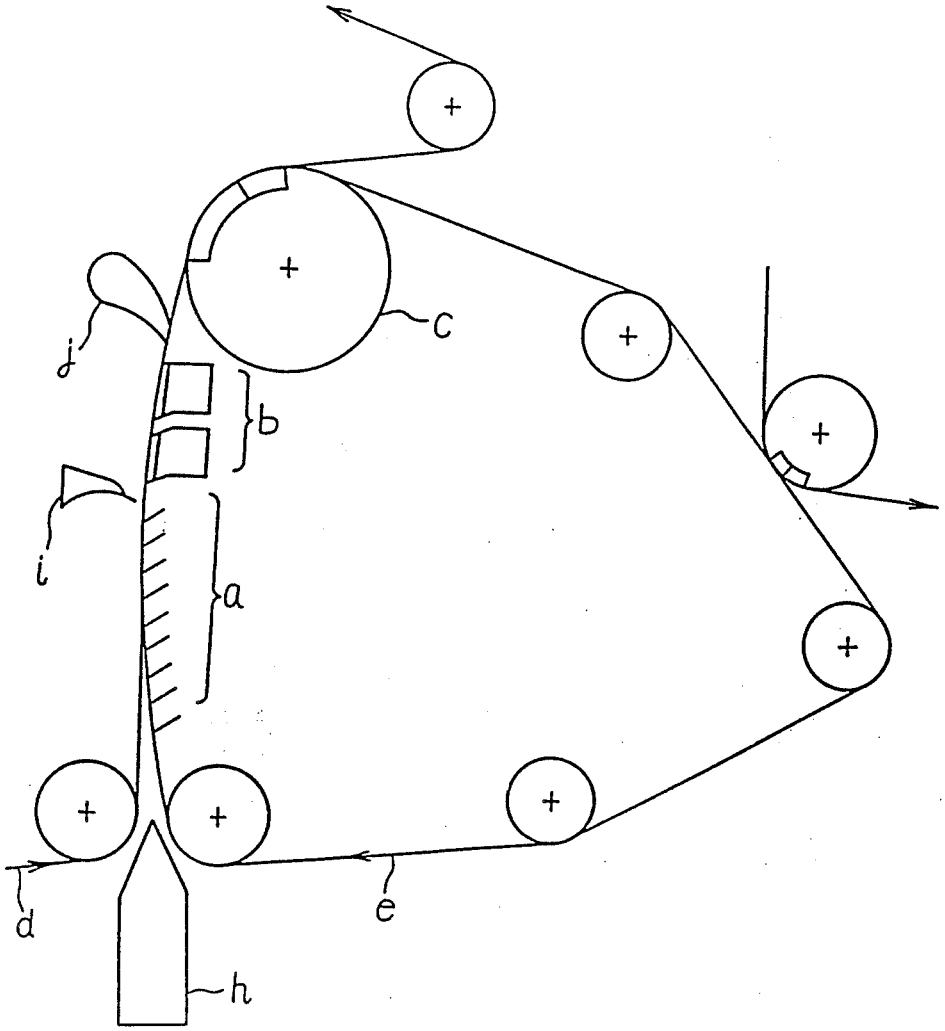
Fig. 3 (PRIOR ART)
FIG. 3 is a side cross-sectional view of a prior art Bel-Baie former.
Figure 4:
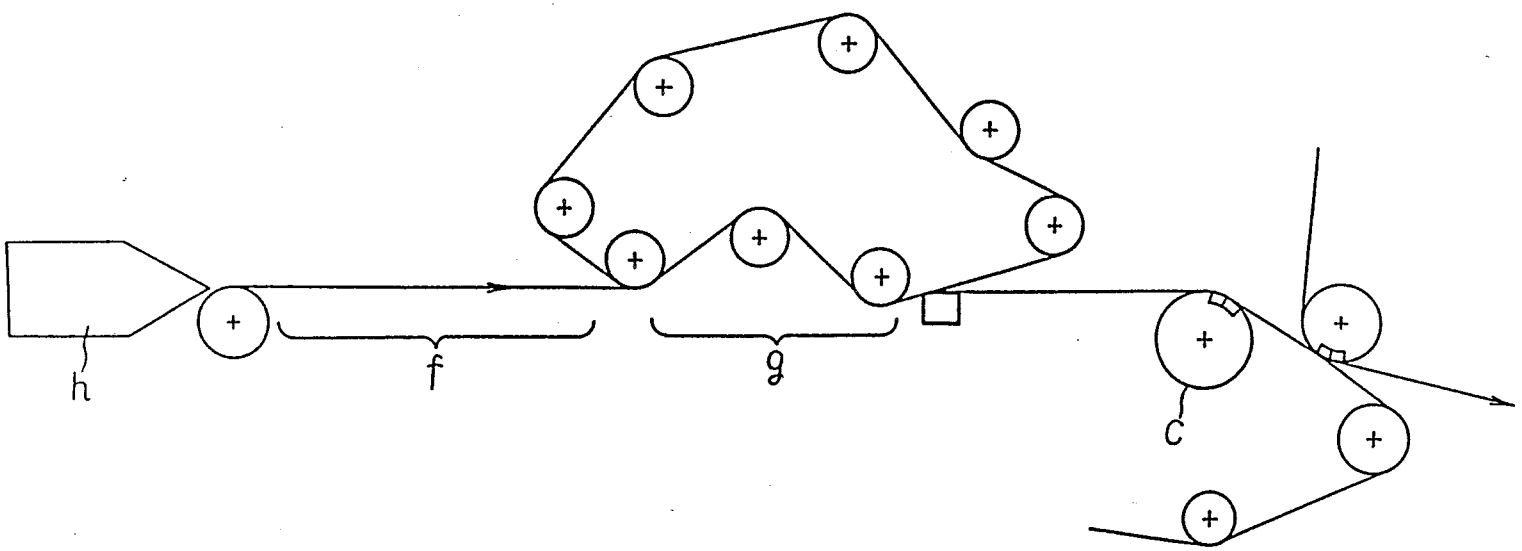
Fig. 4 (PRIOR ART)
FIG. 4 is a side cross-sectional view of a prior art hybrid former.

The explanation for the fact that if such acceleration and deceleration are applied appropriately, then dispersion of fibers is improved, is set forth in Laid-Open Japanese Patent Specification No. 57-89694 published June 4, 1982 and relating to a headbox, and it can be easily confirmed through a simple experiment as illustrated in FIG. 2. That is, paper making raw material 41 is enclosed in a transparent bag 40 made of plastics and is placed on a table, then a roll-like body 42 such as a rod or the like is pressed against it and moved up and down to move the raw material 41 is to the left and to the right. While this roll-like body 42 is held in the state of lightly pressing the bag 40, the rod-like body 42 is moved to the left and to the right by rolling it along the surface of the bag 40, and thereby the raw material 41 in the bag 40 is moved to the left and the right. If such movement is repeated, dispersion of the raw material 41 in the bag 40 becomes uniform.

In the arrangement as shown in FIG. 1, the movement of the raw material for improving dispersion of fibers is similar to the above-described experiment, and is effected under an adjustable condition. During the period in which the raw material has been ejected from the headbox 36 until it reaches the roll 5, since the raw material is dewatered only on the side of the bottom wire 33, the number of repetitions of acceleration and deceleration for improving dispersion of fibers is increased. In addition, in the interval where the belt 35 is traveling along the top wire 34, since dewatering is effected downwards only, the dewatering is asymmetric although the upward dewatering in which the extracted water is collected in the casings 27 and 29 exists.

Therefore, a reduction in the coupling strength in the thicknesswise direction also can be suppressed. In the initial portion of the former where the amount of dewatering is large, since dewatering is effected on the rollers and the wires are not scrubbed by a fixed body, retention is high (although the shoes 14 and 18 and the beam 22 scrub the belt 35, since the belt 35 is traveling at the same velocity as the wire, the wires are not scrubbed by a fixed body). Dewatering of raw material in a liquid state is not effected on a free surface thereof, but it is effected entirely in the state where the raw material is sandwiched between two wires, the state being adjustable, and so, even upon high speed operation no problem arises.

After the downward dewatering has proceeded, the consistency of the raw material has been raised. In order to improve the dispersion, it becomes necessary to carry out abrupt acceleration and deceleration with a stronger pressure variation. In such a case, the set consisting of the shower 16, the shoe 18 and the tube 21 or consisting of the shower 16 and the beam 22 could be provided above the deflector 4. In this case, since the amount of downward dewatering has been reduced, reduction in the retention is not influenced so much.

As to the open roll 3, if a perforated cell such as a suction roll around which a wire is wound, is used therefor, then the dewatering effected at the portion of the roll 3 on the side of the bottom wire 33 is accompanied by a flow tending to move the raw material between the two wires 33 and 34 towards the holes of the cell. Since multiple open rolls 3 are provided, at the location of the next roll, the raw material is moved in a different direction. Such reciprocating movement of the raw material along a plane is effective for uniformly dispersing fibers similarly to the accelerating and decelerating flow as described previously. In the former having the arrangement shown in FIG. 1, an effect of improving the formation of paper due to such actions is also provided.

As explained above, the present invention can achieve excellent effects in that since formation forming on a free surface is not effected, the former is suitable for high speed operation. Also, since adjustable asymmetric dewatering is effected, only small differences exist between the top and bottom sides of the paper sheet, balance for maintaining the lowering of the coupling strength in the thicknesswise direction minimum can be established and also improvement in the formation can be achieved. Moreover, since dewatering is effected mainly by rotary rolls or a belt, a reduction in retention does not occur, and since both surface dewatering is also effected, a surface strength is also high.

What is claimed is:

1. A twin wire former comprising:

a top endless wire loop adjacent a bottom wire endless loop and between which a dewatering section is defined;

a water impermeable belt disposed within said top endless wire loop, said belt travelling along the inner side of said top wire over a first portion of said dewatering section, said top and said bottom wire loops and said belt being positioned so that dewatering occurs in said first portion of the dewatering section on only one side of the twin wire former through the bottom wire, and in a subsequent portion of the dewatering section through both the top and the bottom wires;

a plurality of adjustable rolls or adjustable shoes within said belt and said top wire and over which said belt travels in said first portion of the dewatering section; and adjusting means for adjusting the positions of said rolls or said shoes for varying the relative wrapping angles of the belt and the wires.

* * * * *